US005503339A

United States Patent [19]

Doppstadt

[11] Patent Number: 5,503,339

[45] Date of Patent: Apr. 2, 1996

[54] COMMINUTING MACHINE WITH COMB-LIKE FURTHER COMMINUTING STRUCTURE

[76] Inventor: Werner Doppstadt, Vossnacker Strasse 67, 42555 Velbert, Germany

[21] Appl. No.: 217,377

[22] Filed: Mar. 24, 1994

[30] Foreign Application Priority Data

Apr. 20, 1993 [DE] Germany ..... 9305838 U

[51] Int. Cl.[6] ..... B02C 13/09; B02C 13/26

[52] U.S. Cl. ..... 241/166; 241/187; 241/189.1; 241/243; 241/239

[58] Field of Search ..... 241/166, 167, 241/187, 189.1, 190, 242, 243, 237, 239, 240, 241, 101.7, 285.2, 285.3, 287

[56] References Cited

U.S. PATENT DOCUMENTS

| | | | |
|---|---|---|---|
| 89,669 | 5/1869 | Lee | 241/239 X |
| 1,125,137 | 1/1915 | Liggett . | |
| 2,172,886 | 9/1939 | Gabel | 241/239 X |
| 2,839,254 | 6/1958 | Smith | 241/190 |
| 3,608,841 | 9/1971 | Wageneder | 241/239 X |
| 4,049,206 | 9/1977 | König et al. | 241/241 X |
| 4,146,184 | 3/1979 | Whitney | 241/73 |
| 4,226,375 | 10/1980 | Cameron . | |
| 4,449,673 | 5/1984 | Cameron | 241/186.35 |
| 4,852,816 | 8/1989 | Doppstadt . | |
| 4,905,919 | 3/1990 | Okazaki | 241/190 X |

FOREIGN PATENT DOCUMENTS

| | | | |
|---|---|---|---|
| 212194 | 10/1989 | European Pat. Off. . | |
| 725553 | 2/1932 | France | 241/239 |
| 54559 | 7/1912 | Germany | 241/239 |
| 553054 | 6/1932 | Germany | 241/190 |
| 2902257 | 7/1980 | Germany . | |
| 1123721 | 11/1984 | U.S.S.R. | 241/190 |
| 1230678 | 5/1986 | U.S.S.R. . | |

OTHER PUBLICATIONS

*Doppstadt* Brochure for AK 330 Shredder.

*Primary Examiner*—Timothy V. Eley
*Attorney, Agent, or Firm*—Collard & Roe

[57] ABSTRACT

The comminuting machine includes a housing provided with a rotary impact mechanism. A conveyor conveys infed material to the rotary impact mechanism which cooperates with an impact plate in disintegrating the infed material. A comb-like further comminuting structure follows the impact plate in the rotary direction and is arranged laterally of the rotary impact mechanism. The comb-like further comminuting structure extends over part of a discharge opening of the housing and is linked to a rear end of the impact plate. Displacement devices are provided for displacing the comb-like further comminuting structure between an operative position in which the comb-like further comminuting structure extends laterally of the rotary impact mechanism, and an inoperative position in which the comb-like further comminuting structure is pivoted away therefrom. Adjusting devices are provided for adjusting the comb-like further comminuting structure relative to the rotary impact mechanism.

18 Claims, 5 Drawing Sheets

COMMINUTING MACHINE WITH COMB-LIKE FURTHER COMMINUTING STRUCTURE

CROSS-REFERENCE TO RELATED APPLICATION

This application is related to my copending U.S. patent applications Ser. No. 08/215326, filed Mar. 21, 1994, entitled "Mobile Material Processing Machine With Tandem Axle"; Ser. No. 08/215523, filed Mar. 22, 1994, entitled "Arcuate Impact Plate and Comminuting Machine With Arcuate Impact Plate"; Ser. No. 08/215521, filed Mar. 22, 1994, entitled "Comminuting Machine With Comminution Grates"; Ser. No. 08/217388, filed Mar. 24, 1994, entitled "Comminuting Machine With Comminution Cover Plate"; and Ser. No. 08/217372, filed Mar. 24, 1994, and entitled "Infeed Means For Comminuting Machine".

BACKGROUND OF THE INVENTION

The present invention relates to a new and improved construction of a comminuting machine.

In its more particular aspects, the present invention specifically relates to a new and improved construction of a comminuting machine for comminuting waste material which may be intended to be composted. Generally, such machines are mounted at a mobile support frame and comprise a housing in the form of a container for receiving the material to be comminuted. A conveyor is disposed in the housing or container for conveying the infed material to a rotary impact mechanism. The rotary impact mechanism cooperates with an impact plate in a comminuting section which precedes a discharge opening of the housing or container for discharging the comminuted material under the action of the rotary impact mechanism. The impact plate may be followed by further comminuting means through which the comminuted material is discharged with further comminution. The comminuted material may be deposited in stacks or pits for composting.

A comminuting machine or composting equipment such as known, for example, from U.S. Pat. No. 4,852,816, granted on Aug. 1, 1989, to the applicant of the instant application, is constructed for comminuting organic or wood waste originating in forestry, municipality or building operations. A trough-shaped container receives the material to be comminuted, for example, by means of a shovel loader. Infeed means are provided in the form of an infeed conveyor which is located above the bottom of the container and feeds the material to a rotary impact mechanism which drives the infed material through an entrance gap defined between an impact ledge and rotating flails of the rotary impact mechanism. The impact ledge is followed by retainer claws which extend between adjacent ones of the rotating flails for comminuting the material which has been forced through the entrance gap. An impact plate follows the retainer claws and has teeth protruding toward the rotating flails and cooperating therewith for further comminuting the material prior to its discharge through a discharge opening from a rear part of the container.

In a further development (Doppstadt shredder, type AK 330) of the aforementioned comminuting machine the infeed means further include an intake roll which bears upon the infed material from above. The entrance gap is followed by an impact plate containing two plate sections. The two plate sections are arranged at an angle with respect to each other so that the impact plate extends along an upper part of the cylindrical action area of the rotating flails. Teeth protrude from the impact plate toward the rotating flails and are arranged in parallel rows transverse with respect to the rotational direction of the rotating flails, the rows of teeth being transversely offset from each other. There is thus defined a throughpass gap through which the incoming material is forced under the action of the rotating flails and subjected to comminuting action. The impact plate may be immediately followed by further comminuting means disposed laterally of the rotating flails at the discharge opening of the container. This further comminuting means is formed by a comb-like frame containing upper and lower traverses; generally arcuately shaped struts extend between the upper and lower traverses in a spaced parallel relationship to each other and have teeth protruding upwardly in opposition to the rotating flails. The comminuted material is thereby subjected to further comminution and forced out through the spaces existing between the struts. The further comminuting means is pivotally mounted by means of the upper traverse.

In both of the aforementioned comminuting machines the impact plate as well as the further comminuting means are pivotably supported so as to pivot away from the rotating flails in the event that the infed material contains pieces of material which do not disintegrate under the action of the rotating flails in cooperation with the impact plate. The rotary impact mechanism and the impact plate are thus prevented from damage by pieces of non-disintegratable material. Hydraulic displacement means are provided in the Doppstadt AK 330 shredder on the outer side of the impact plate and linked to the further comminuting means for displacing the same between an operative position, in which the discharge opening is covered thereby, and an inoperative position, in which the further comminuting means is pivoted away from the discharge opening.

Furthermore, both of the aforementioned comminuting machines are mobile machines mounted at a support frame on wheels. Such wheel support can be provided by supporting the comminuting machine on a truck such as known from European Patent No. 0,212,194, the grant of which to the applicant of the instant application was published on Oct. 11, 1987; in such construction the engine of the truck also serves to drive the comminuting machine. The wheel-supported support frame may also carry the drive means for operating the comminuting machine; as described in the aforementioned U.S. patent, such comminuting machine may be displaced at the given working location by means of the shovel loader used for charging the comminuting machine. The support frame may also be supported at a tandem axle. Pressure fluid operated drive means acting upon the front wheels of the tandem axle may be provided for displacing the comminuting machine at the working location (Doppstadt shredder AK 330). Remote control means may be used for controlling the operation of the comminuting machine including the pressure fluid operated drive means. While the machine can be operated in this manner independent of a truck, travel to a different working location requires connection to a towing vehicle like a tractor or truck.

Still further, both of the aforementioned mobile comminuting machines are equipped with an overload coupling and/or overload control means which respond to deceleration of the rotary impact mechanism in the presence of excessive infed material to be comminuted. Such overload coupling mainly serves to dampen rapid transient variations in the rotational speed of the rotary impact mechanism due to a momentary overload so that the same do not or only little affect a prime mover. The overload control means react to the overload by decelerating and eventually stopping infeed drive means as a function of the rotational speed of the rotary impact mechanism.

A stationary comminuting machine such as known, for example, from German Published Patent Application No. 2,902,257, published on Jul. 31, 1980, is intended for comminuting particularly confidential files but also waste materials of any kind including waste wood. Infeed means like infeed rolls feed the material to an inlet gap and into the interior of a drum-like housing. Parts of the infed material protrude through the inlet gap and are severed or chopped off by a rotary impact mechanism. A drum-like housing of the comminuting machine accommodates a basically segment-shaped impact body defining a throughpass gap in cooperation with the rotary impact mechanism. The throughpass gap narrows from an inlet for infeeding the material to be comminuted to an outlet and extends around the upper half of the rotary impact mechanism. The impact body is mounted at the drum-like housing by means of bolts permitting adjustment of the impact body in radial direction relative to the rotary impact mechanism. At its rear end, as viewed in the rotational direction of the rotary impact mechanism, the impact body bears upon a stop. The impact body is provided on its inner side with, for example, a saw-tooth profile which extends parallel to the axis of the rotary impact mechanism. The impact body is followed, in the rotational direction of the rotary impact mechanism, by grate means which extends around the lower half of the rotary impact mechanism and defines a throughpass gap which narrows in the rotational direction.

A stationary comminuting machine or pulverizer such as known, for example, from U.S. Pat. No. 1,125,137 is constructed as a hammer mill into which the material to be comminuted is dropped from the top. The incoming material is hit by a rotary shaft with spiders extending radially therefrom and provided with swinging hammers at their free ends. The hammers cooperate with different breaking plates extending in sequence around part of the circumference defined by the rotating hammers. A first breaking plate presents a smooth surface to the rotating hammers; a second breaking plate is provided with a sequence of teeth formed by faces which rise from the plate in the direction of rotation of the rotating hammers; a third breaking plate extends along the lower half of the circumference described by the rotating hammers and contains a number of bars arranged at an angle relative to the associated faces of the rotating hammers. The spaces between the bars serve as discharge openings for the comminuted material. A section of the support structure for the bars of the third breaking plate can be pivoted away from the circumference described by the rotating hammers by manually operated pivot means in order to permit removal of material which can not be sufficiently reduced.

A further stationary comminuting machine or reduction mill such as known, for example, from U.S. Pat. No. 4,226,375, granted Oct. 7, 1980, is also constructed in the manner of a hammer mill into which the material to be comminuted is dropped from the top. The incoming material is hit by a rotary body from which hammers protrude in essentially radial direction. An anvil wall extends along a lower quadrant of the rotary body and defines a channel which narrows in the rotary direction of the rotary body. The anvil wall is immediately followed by a grate section extending laterally of the rotary body over an angle of 140° to 170°. The grate section cooperates with the rotating hammers in a manner such that the infed material is further comminuted and forced through screen openings of the grate section. The grate section is formed by a circumferentially sequential assembly of cutter bars and screen bars which are mounted in a common housing. The housing can be pivoted away from the rotary body in order to permit access for maintenance and repair operations on the grate section and the hammers.

In a further known stationary comminuting machine such as a hammer mill known from Author Certificate USSR No. 1,230,678, published May 15, 1986, the material to be comminuted is infed from the top and hit by rotating hammers of a rotor. The rotating hammers cooperate first with an impact plate which is arranged above the rotating hammers and generally extends in the direction of rotation of the rotating hammers. The impact plate is provided with transversely and lengthwisely extending ribs protruding toward the rotating hammers. A second impact plate follows the first impact plate at an obtuse angle relative thereto; this second impact plate is provided with angular impact elements defining tips which are directed toward the rotating hammers. This second impact plate is immediately followed by a third, planar impact plate downwardly inclined toward the rotor. Finally, a grate immediately follows the third impact plate and semicylindrically surrounds the lower half of the rotor. The comminuted material is forced and discharged through the grate under the action of the rotating hammers.

Contrary to the first mentioned mobile waste comminuting machines, the last mentioned stationary comminuting machines are not provided with any means permitting the impact plates and other structures which cooperate with the rotating hammers, to yield in the presence of non-disintegratable material.

Regarding the aforementioned mobile waste comminuting machines, the comminuting actions realized therein have been found to be unsatisfactory not only with respect to the further comminuting effect on fibrous material which has been forced past the impact plate, but also with respect to blockage of the spaces in the further comminuting means by the comminuted material.

SUMMARY OF THE INVENTION

Therefore, with the foregoing in mind, it is a primary object of the present invention to provide a new and improved construction of a comminuting machine which is not afflicted with the drawbacks and limitations of the prior art constructions heretofore discussed.

Another and more specific object of the invention is directed to the provision of a new and improved construction of a comminuting machine in which the further comminuting means are constructed to favorably affect further comminuting action particularly on fibrous material which has passed the impact plate.

It is an important object of the invention to provide a new and improved construction of a comminuting machine in which the further comminuting means are protected from blockage by further comminuted material.

A further significant object of the present invention resides in providing a new and improved construction of a comminuting machine in which the further comminuting means are protected against damage by pieces of non-disintegratable material.

Now in order to implement these and still further objects of the invention, which will become more readily apparent as the description proceeds, the comminuting machine of the present development is manifested by the features that, among other things, the further comminuting means comprise a comb-like structure formed by struts disposed substantially parallel to each other. The struts extend in the rotational direction of the rotary impact mechanism and have teeth protruding in opposition to the rotational direction. The comb-like structure partially covers the discharge opening in the rotational direction of the rotary impact mechanism.

Due to the inventive construction, eventually present fibrous material is driven by the rotary impact mechanism toward the comb-like further comminuting means or structure and forced through the spaces between the adjacent struts. The teeth on the inner side of the struts oppose the rotational direction of the rotating flails and exert a tearing action on the fibrous material as it is driven on by the rotating flails. As a result, the fibrous material is prevented from becoming entrained by the rotating flails.

Furthermore, since the comb-like further comminuting means or structure in the inventive comminuting machine do not cover the entire discharge opening, the rotating flails act upon any material which tends to adhere to the comb-like structure and to obstruct the intermediate spaces between the struts thereof, to tear the same off therefrom and force it out of the open part of the discharge opening below the comb-like further comminuting means. In this manner, blockage of the comb-like structure is effectively prevented.

BRIEF DESCRIPTION OF THE DRAWINGS

The invention will be better understood and objects other than those set forth above, will become apparent when consideration is given to the following detailed description thereof. Such description makes reference to the annexed drawings wherein the same or analogous components are designated by the same reference characters and wherein.

BRIEF DESCRIPTION OF THE PREFERRED EMBODIMENTS

Figure 1:
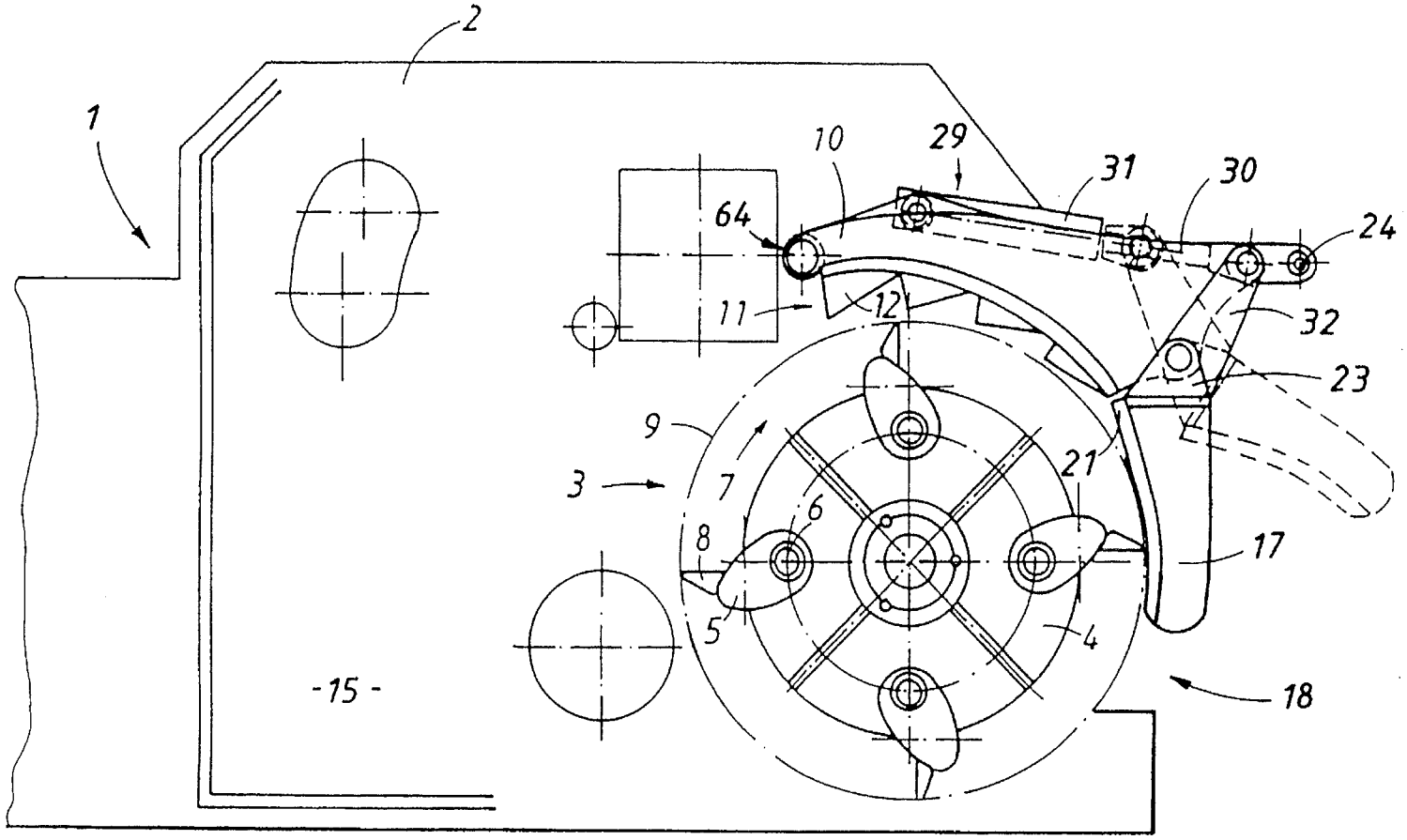
FIG. 1 is a schematic, partially sectional side view of an exemplary embodiment of the inventive comminuting machine.

Describing now the drawings, it is to be understood that only enough of the construction of the comminuting machine has been shown as needed for those skilled in the art to readily understand the underlying principles and concepts of the present development, while simplifying the showing of the drawing. Generally, the inventive comminuting machine includes a stationary or mobile housing which houses a rotary impact mechanism and receives the material to be comminuted, namely domestic or industrial waste. While the illustrated exemplary embodiment is concerned with a mobile machine of this type which is supported at a wheel-supported support frame which also carries the drive means for operating the machine, it will be understood that the inventive construction can also be realized in connection with a truck supported mobile comminuting machine. Also, the illustrated exemplary embodiment may be provided with independent drive means as disclosed in the first initially cross-referenced U.S. patent application. Naturally, the inventive construction is not limited to the illustrated example of a waste comminuting machine but can also be realized in connection with comminuting machines for processing other kinds of material and based on the same basic constructional principles.

Turning attention now to FIG. 1 of the drawings, there has been shown in a schematic, partially sectional side view a comminuting machine 1 and a housing 2 thereof. This housing 2 may constitute, for example, the rear part of a trough-shaped container having a not particularly illustrated central portion which receives the material to be comminuted. Conveying means such as a scraper conveyor conveys the infed material to this rear part which houses the actual comminuting mechanism to be described hereinbelow. On a front part of a support frame (not shown) of the comminuting machine, there may be located drive means for operating the comminuting machine. Such drive means may comprise, for example, a diesel engine representing the prime mover and a pressure fluid operated drive system including an axial piston pump which is in driving connection with the prime mover and which supplies pressure fluid to various pressure fluid operated components of the comminuting machine.

The actual comminuting mechanism is accommodated by the housing or container rear part 2. This comminuting mechanism is constituted by a rotary impact mechanism 3 which basically is of a construction similar to that of the initially mentioned Doppstadt AK 330 shredder. A drum 4 is equipped with flails 5 each of which is pivotably supported about a pivot axis 6. During revolution of the drum 4 in the rotational direction as indicated by the arrow 7, the flails 5 are subject to a centrifugal force and pivot outwardly in known manner. As a result, cutting members 8 of the flails 5 define a substantially cylindrical area 9 of action. The flails 5 are arranged in axial rows which are substantially transversely offset from each other in order to form a substantially uninterrupted cylindrical area 9 of action. The material to be comminuted is infed into the area 9 of action of the rotary impact mechanism 3 by infeed means including, for example, a conveying device like the initially mentioned scraper conveyor and a heavy-weight intake roll.

Figure 2:
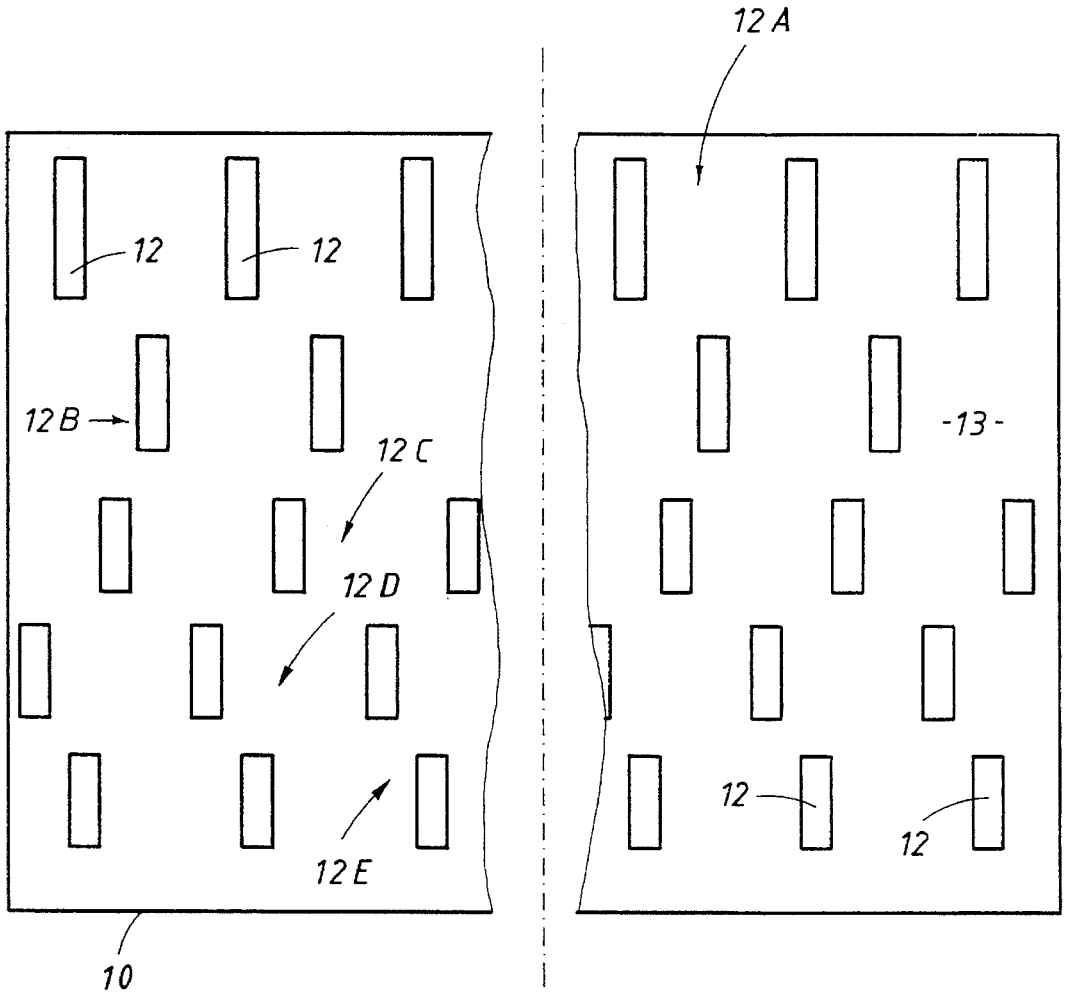
FIG. 2 is a top plan view of the inner side of an impact plate in the comminuting machine as shown in FIG. 1.

An impact plate 10 is arranged in the container rear part 2 for cooperation with the area 9 of action of the rotary impact mechanism 3. The impact plate 10 extends in an arcuate manner along a top portion of the rotary impact mechanism 3 to define a throughpass gap 11 which narrows in the rotational direction of the rotary impact mechanism 3 or the rotating flails 5. Teeth 12 protrude from an inner side 13 of the impact plate 10 in a direction opposing the rotational direction 7 of the rotary impact mechanism 3, namely in a manner such that the protruding height of the teeth 12 above the inner side 13 of the impact plate 10 decreases in the rotational direction 7. As illustrated in FIG. 2, the teeth 12 are arranged across the inner side 13 of the impact plate 10 in a plural number of rows such as 12A, 12B,12C,12D and 12E which extend substantially parallel to each other and substantially transverse with respect to the rotational direction 7 of the rotary impact mechanism 3. The parallel rows of teeth are transversely offset from each other in a manner such that the formation of longitudinal teeth rows extending parallel to the rotational direction 7 is avoided. This has a beneficial effect on the comminution efficiency of the machine. The specific structure of the impact plate 10 is disclosed in detail in the second initially cross-referenced U.S. patent application by the applicant of the instant application and the disclosure of this application is incorporated herein by reference. Suffice it to state at this place that the teeth 12 conjointly with the rotary impact mechanism 3 define the throughpass gap 11 and that the material which has passed through the aforementioned entrance gap and which thereby has been subjected to a first comminuting action, is forced through the throughpass gap 11 with concomitant comminution due to the driving action of the rotating flails 5 and their cooperation with the teeth 10.

Figure 3:
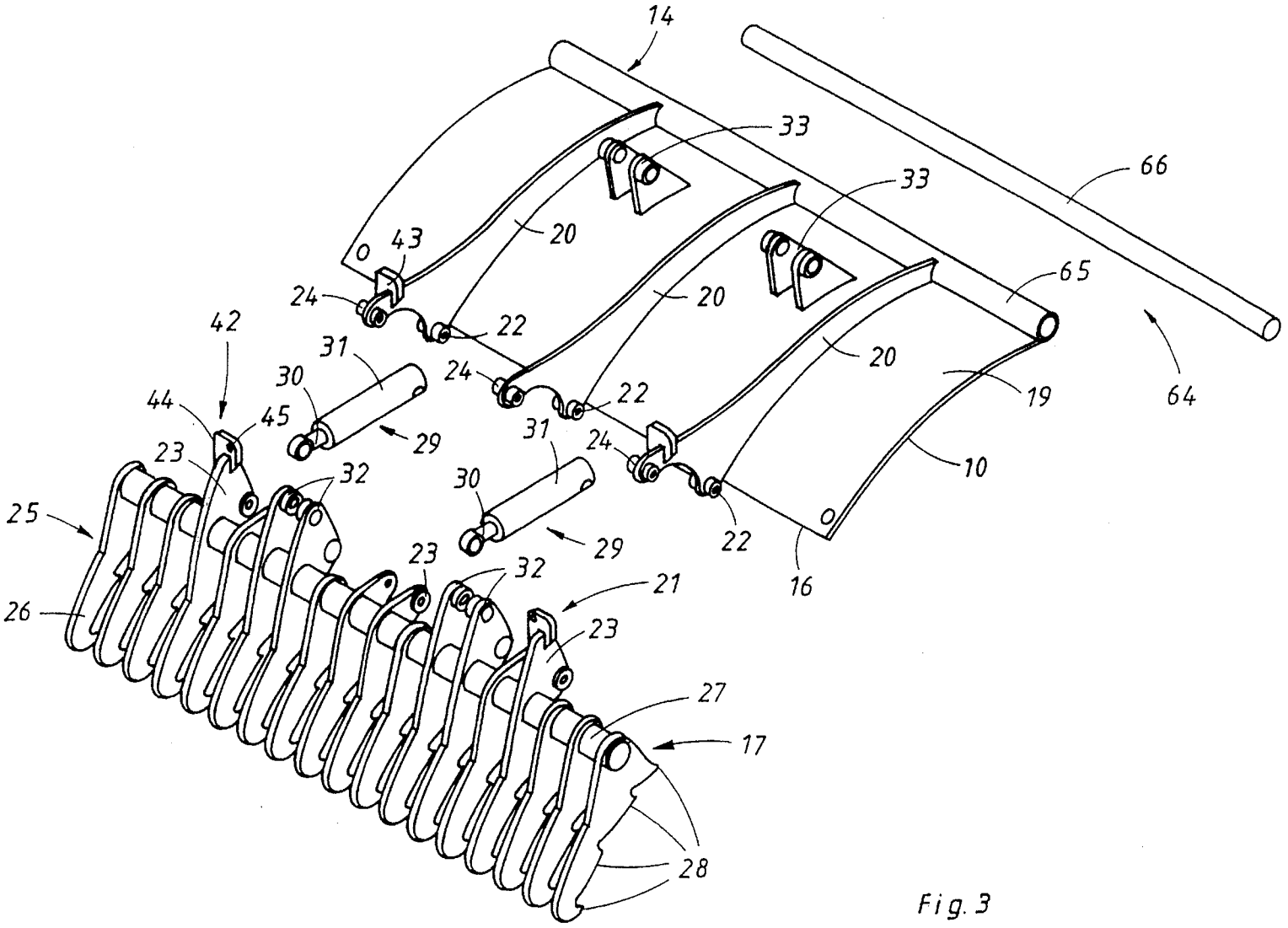
FIG. 3 is a perspective view in an expanded state of the impact plate and further comminuting means in the comminuting machine as shown in FIG. 1.

At its front end 14, see FIG. 3 and as viewed in the rotational direction 7 of the impact mechanism 3, the impact plate 10 is pivotably supported at opposite side walls of the container rear part 2 of which only the side wall 15 is visible in FIG. 1. At this end, the impact plate 10 is provided with a pivot bearing 64 containing a tubular bearing 65 surrounding a pivot shaft 66 having ends which are respectively secured to the opposite side walls. With its rear end 16, as viewed in the rotational direction 7, the impact plate 10 rests upon stops (not shown) located at the inner face of the side walls of the container rear part 2. In this manner it will be achieved that non-disintegratable pieces of material like metallic articles or stones can not cause damage at the impact plate 10 because the impact plate 10 is pivotably raised in the presence of such non-disintegratable pieces and thus permits the same to pass through the throughpass gap 11.

The impact plate 10 is followed in the rotational direction 7 by further comminuting means 17 which will be described hereinafter in detail with reference to FIG. 2. The material which issues from the throughpass gap 11 as defined by the impact plate 10, is driven on by the rotary impact mechanism 3 in the rotational direction 7. It is subjected to further comminution due to the cooperation of the rotary impact mechanism 3 and the further comminuting means 17 and thereby forced through the same. The further comminuting means 17 cover only part of a discharge opening 18 in the container rear part 2 as viewed in the rotational direction 7 of the rotary impact mechanism 3. Consequently, any material which is not passed through the further comminuting means 17 or adheres thereto, is driven further on by the cutting members 8 of the rotating flails 5 which rotate at the relatively high rotational speed of, for instance, 1000 revolutions per minute, in the rotational direction 7 and passed through the remaining still open part of the discharge opening 18.

In FIG. 1, the further comminuting means 17 is shown in its operative position in which the discharge opening 18 of the container rear part 2 is partially covered by the further comminuting means 17. Broken lines therein indicate that the further comminuting means 17 can be pivoted from this operative position into an inoperative, open position in which the further comminuting means 17 is pivoted away from the area 9 of action of the rotary impact mechanism 3 and the discharge opening 18 of the container rear part 2 is fully open. Displacing means 29 serve this purpose and will be described further hereinbelow.

The arrangement of the further comminuting means 17 with respect to the impact plate 10 will be recognized in more detail in FIG. 3. The further comminuting means 17 immediately follows the impact plate 10. This is accomplished in that the impact plate 10 is provided with a plural number of carriers 20 which are disposed on the outer side 19 of the impact plate 10 and extend in the rotational direction 7 beyond the impact plate 10 to protrude toward a front end 21 of the further comminuting means 17. The carriers 20 of the impact plate 10 comprise respective mounting members 22 which are linked to the further comminuting means 17 through respective link members 23 fixedly connected to the front end 21 and rising therefrom. Further free ends 24 of the carriers 20 are linked to a cover plate 46 to be further described hereinbelow with reference to FIG. 5.

In detail, the further comminuting means 17 constitutes a comb-like structure 25 composed of a plural number of struts 26 which extend substantially parallel to each other and from the first end 21 of the comb-like structure 25 generally in the rotational direction 7 of the rotary impact mechanism 3. The struts 26 are of a generally arcuate shape having one of their ends fixedly connected to a common carrier or beam 27 while the other one of their ends is a free end of rounded configuration. Between their ends and on the side facing the rotary impact mechanism 3 or the rotating flails 5, the struts 26 are provided with a multiple number of teeth 28 which extend generally upwardly in opposition to the rotational direction 7 or the movement of the rotating flails 5. In the illustrated exemplary embodiment, each strut 26 is provided with a total of four such teeth 28, however, there may be present any suitable number of teeth 28 depending upon the particularly prevailing comminution conditions. While the comb-like structure 25 covers substantially the entire width of the discharge opening 18, it will be recognized from FIG. 1 that the comb-like structure 25 covers only about one half of the length of the discharge opening 18 as viewed in the rotational direction 7. Generally, and depending upon the comminuting conditions, the comb-like comminuting structure 25 may extend over between one third and two thirds of such length of the discharge opening 18.

Those ones of the struts 26 which are aligned to the aforementioned carriers 20 provided on the outer side 19 of the impact plate 10, are equipped with the aforementioned link members 23 in order to provide a link connection between the comb-like structure 25 and the impact plate 10.

Displacing means 29 additionally interconnect the impact plate 10 and the comb-like structure 25 or further comminuting means 17. The displacing means 29 as illustrated are composed of essentially two pressure fluid operated piston-cylinder units 30,31, however, at least one thereof or even a greater number thereof may be provided, if desired. The piston rods 30 of the displacing means 29 are connected to respective arms 32 which upwardly extend at the front end 21 of the further comminuting means 17 from those struts 26 of the comb-like structure 25 which are aligned to brackets 33 on the outer side 19 of the impact plate 10. The cylinders 31 of the displacing means 29 are linked to these brackets 32. It will be recognized that the comb-like structure 25 will be pivoted into the operative position within or covering the respective part of the discharge opening 18 in the container rear part 2, as shown in FIG. 1, when the pistons 30 assume their extended position. Conversely, the comb-like structure 25 will be pivoted into the inoperative position away from the rotary impact mechanism 3 and the discharge opening 18, as shown in broken lines in FIG. 1, once the pistons 30 assume their retracted positions.

In the event that a piece of non-disintegrable material passes through the throughpass gap 11 defined between the impact plate 10 and the rotary impact mechanism 3 under the action of the rotary impact mechanism 3, such piece of non-disintegratable material will act upon the further comminuting grate 17 or comb-like structure 25 to pivot the same into the inoperative, open position. Consequently, the piston rods 30 will be displaced into the cylinder 31. The comb-like structure 25 will remain in the opened position also after the piece of non-disintegrable material has passed through the discharge opening 18 of the container rear part 2. In order to return the further comminuting means 17 or comb-like structure 25 into its operative position, the displacement means 29 is operated to effect the re-pivoting operation.

Figure 4:
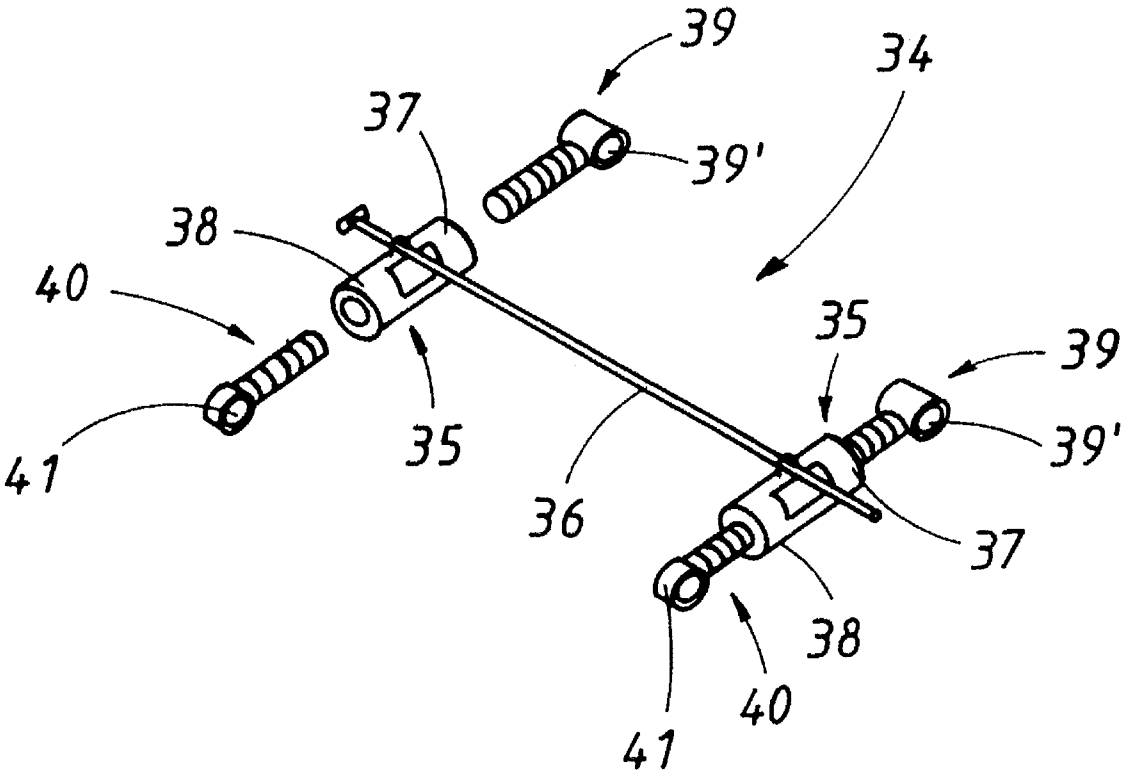
FIG. 4 is a perspective view of adjusting means associated with one end of the comb-like further comminuting structure in the comminuting machine as shown in FIG. 1.

A further exemplary embodiment of the aforementioned displacing means is schematically shown in perspective in FIG. 4 in the form of mechanically operated displacing means 34. Basically, the mechanical displacing means 34 consist of at least one threaded bushing 35, preferably two threaded bushings 35 or, if desired, a greater number thereof. The threaded bushings 35 are interconnected by means of a connecting rod 36. The threaded bushings 35 have respective first ends 37 and respective second ends 38. Two first threaded bolts 39 are threaded into the first end 37 of the respective threaded bushings 35 and have their free ends 39' linked to the aforementioned brackets 33 on the outer side 19 of the impact plate 10. Two second threaded bolts 40 are threaded into the second end 38 of the respective threaded bushings 35 and have their free ends 41 linked to the respective arms 32 which upwardly rise from the front end 21 of the comb-like structure 25. Consequently, the comb-like structure is pivoted into or away from the discharge opening 18 in the container rear part 2 depending upon the direction in which the threaded bushings 35 are rotated, i.e. which one of the threaded bolts 39 or 40 is extended from or retracted into the bushings 35.

Furthermore, adjusting means 42 are associated with the front end 21 of the further comminuting means 17 and the impact plate 10. The further comminuting means 17 or the comb-like structure 25 may be adjusted thereby relative to the rotary impact mechanism 3. The adjusting means 42 is formed in connection with the carriers 20 on the outer side 19 of the impact plate 10. Upwardly rising link members 23 at the struts 26 are aligned therewith. In the illustrated exemplary embodiment, the adjusting means 42 are provided at the laterally disposed carriers 20 and the associated struts 26. Stops 43 are mounted at the protruding free ends of the carriers 20 and respective upstanding holders 44 are located at the associated link members 23 and traversed by threaded bores 45. An adjusting member (not shown) which is constructed as an adjusting screw, extends through the threaded bore 45 and engages the stop 43. Operation of the adjusting members or screws will move the front end 21 of the further comminuting means 17 or the comb-like structure 25 toward or away from the area 9 of action of the rotary impact mechanism 3.

Figure 5:
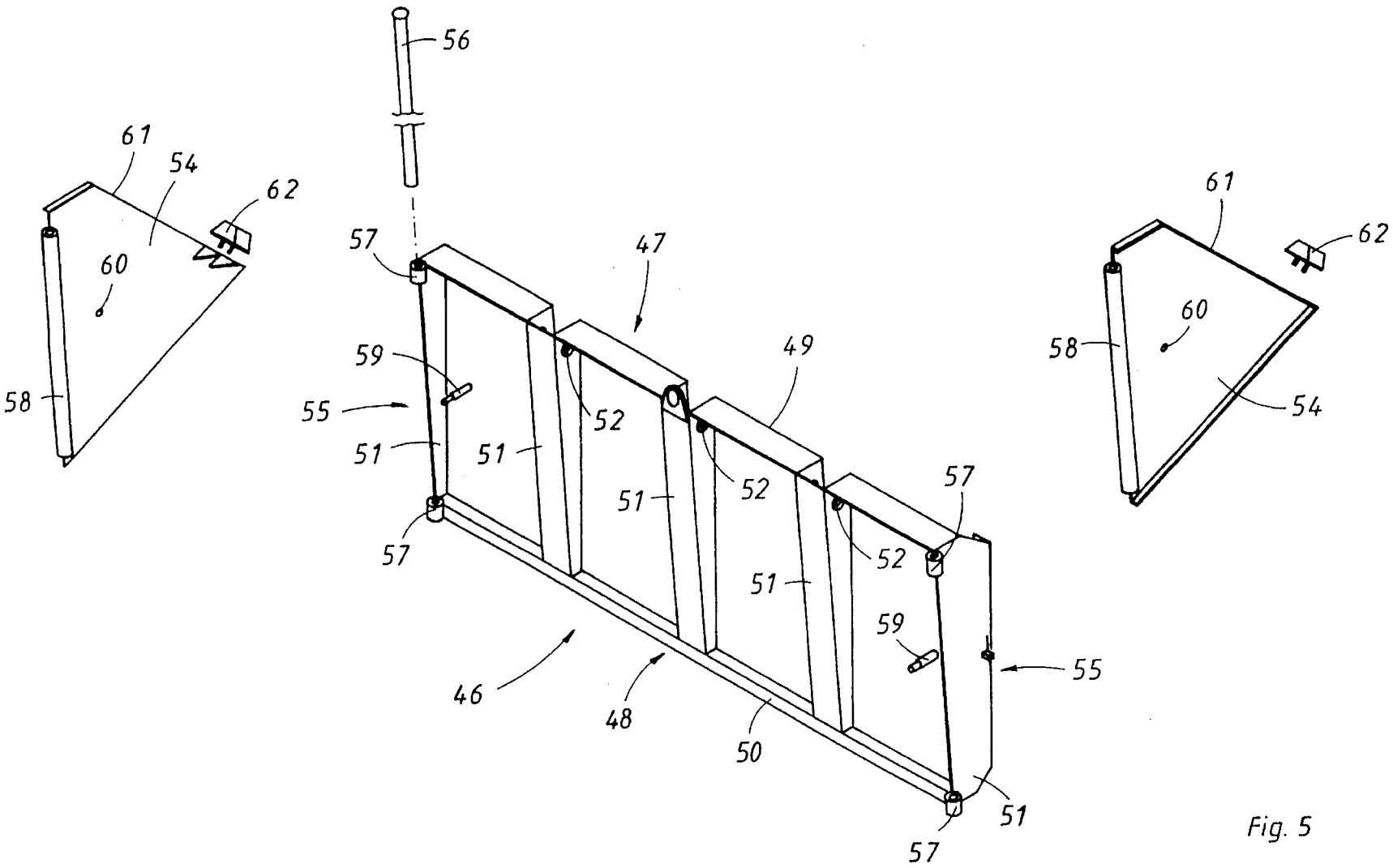
FIG. 5 is a perspective view of a cover plate covering the discharge opening and the comb-like further comminuting structure in the inoperative state of the comminuting machine as shown in FIG. 1.

The further comminuting means 17 and thus the discharge opening 18 of the comminuting machine 1 may be further provided with a cover plate 46 and means for holding the cover plate 46 in an open position, see FIG. 5. Specifically, the cover plate 46 constitutes a plastic or sheet metal plate defining a front end 47 and a rear end 48, as viewed in the rotational direction of the rotary impact mechanism 3, which are provided with reinforcements 49 and 50 extending therealong. The reinforcement 49 at the front end 47 is interrupted by further reinforcements 51 extending at mutual spacings between the front and rear end reinforcements 49 and 50. The top ends of the reinforcements 51 contain link holes 52 by means of which the cover plate 46 is linked to the free ends 24 of the carriers 20 on the outer side 19 of the impact plate 10, as shown in FIGS. 1 and 3.

In the inoperative state of the comminuting machine 1, the cover plate 46 closes the discharge opening 18 of the container rear part 2 by depending from the free ends 24. Holding means of suitable conventional construction, particularly spring loaded holding means, are provided at the lower portion of the container rear part 2 for holding the dependent cover plate 46, if desired. Trapezoidally shaped support members 54 are pivotably mounted at the lateral sides 55 of the cover plate 46. To this end, respective pivot shafts 56 extend through respective eyes 57 fixed to the four corners of the cover plate 46, and a pivot bearing 58 is mounted at the associated sides of the respective support members 54. The outer side of the cover plate 46 has affixed thereto two holding pins 59 which are received in associated holes 60 of the support members 54. Linch pins or equivalent means are used to secure the support members 54 in the inwardly pivoted position in the inoperative state of the comminuting machine 1.

In the operative state of the comminuting machine 1, the cover plate 46 is upwardly pivoted about the link connection at the free ends 24 of the carriers 20 and the support members 54 are released from the holding pins 59. The support members 54 are pivoted about the respective pivot shafts 56 into a position in which their edges 61 abut the outer side of the container rear part 2. Rubber or plastic buffers 62 are provided at the edges 61 for preventing damage. Consequently, the cover plate 46 is supported at the container rear part 2 in an upwardly pivoted position such that the cover plate 46 extends in a downwardly inclined direction from the rear end 16 of the impact plate 10. It is thereby achieved that any upwardly directed comminuted material which issues from the further comminuting means 17, is downwardly deflected toward the stack or pit of accumulating comminuted material.

Like the initially mentioned mobile comminuting machines, the inventive comminuting machine may also be equipped with the known overload coupling and/or overload control means which respond to an overload at the rotary impact mechanism. As explained hereinbefore, such overload coupling like, for example, a fluid coupling mainly serves to dampen rapid transient variations in the rotational speed of the rotary impact mechanism due to a momentary overload whereas the overload control means react to the overload by decelerating and eventually stopping infeed drive means driving the infeed means for conveying the infed material to the rotary impact mechanism.

While there are shown and described present preferred embodiments of the invention, it is to be distinctly understood that the invention is not limited thereto, but may be otherwise variously embodied and practiced within the the scope of the following claims.

What is claim is:

1. A comminuting machine comprising:

a housing for receiving material to be comminuted;

a rotary impact mechanism disposed in said housing and defining a rotational direction;

an impact plate constituting a first comminuting means arranged in said housing and extending along a top portion of said rotary impact mechanism for comminuting cooperation therewith;

said housing having a discharge opening disposed laterally of said rotary impact mechanism and having a predetermined width and a predetermined lenght as viewed in said rotational direction of said rotary impact mechanism;

further comminuting means following said impact plate in said rotational direction;

said further comminuting means covering said discharge opening along a length less than said predetermined length;

said impact plate defines a rear end as viewed in said rotational direction of said rotary impact mechanism;

said further comminuting means comprising a comb structure;

said comb structure containing a plural number of substantially parallel struts which are spaced from each other by a predetermined mutual spacing and which extend generally in said rotational direction of said rotary impact mechanism;

each one of said plural number of struts being provided with a multiple number of teeth directed to oppose said rotational direction and located on a side facing said rotary impact mechanism;

said impact plate defining a rear end as viewed in said rotational direction of said rotary impact mechanism; and said comb structure being linked to said rear end of said impact plate.

2. The comminuting machine as defined in claim 1, wherein said predetermined length of said discharge opening covered by said further comminuting means amounts to one third to two thirds of said discharge opening as viewed in said rotational direction of said rotary impact mechanism.

3. The comminuting machine as defined in claim 1, further including:

a common support extending across said predetermined width of said discharge opening of said housing; and said plural number of struts being arranged at said common support.

4. The comminuting machine as defined in claim 1, wherein:

said impact plate defines an outer side remote from said rotary impact mechanism;

a plural number of carriers mounted at said outer side of said impact plate and extending substantially parallel to said rotational direction of said rotary impact mechanism;

said plural number of carriers defining respective ends facing said comb structure;

mounting members provided at said ends of said plural number of carriers;

said comb structure having a front end facing said rear end of said impact plate;

selected ones of said plural number of struts being provided with link members at their ends facing said mounting members at said ends of said plural number of carriers; and said mounting members of said carriers being linked to associated ones of said link members of said selected struts of said comb structure.

5. The comminuting machine as defined in claim 4, wherein:

said mounting members protrude over said rear end of said impact plate; and said link members protruding upwardly toward said mounting members from said selected struts.

6. The comminuting machine as defined in claim 1, further including adjusting means for adjusting said further comminuting means in a direction toward and away from said rotary impact mechanism.

7. The comminuting machine as defined in claim 6, wherein:

said further comminuting means defines a front end as viewed in said rotational direction of said rotary impact mechanism;

a plural number of link members fixedly connected to said front end of said further comminuting means;

at least two of said plural number of link members being provided with respective ones of at least two holders;

a plural number of carriers mounted at said impact plate and extending along said impact plate to said front end of said further comminuting means;

at least two of said carriers being associated with said at least two link members;

respective stops being provided at said at least two carriers and facing said at least two holders at said at least two link members; and at least two adjusting members extending between said stops and respective ones of said holders and being adjustable for adjusting said further comminuting means in a direction toward and away from said rotary impact mechanism.

8. The comminuting machine as defined in claim 1, further including:

displacing means for displacing said further comminuting means from an operative position covering said predetermined length of said discharge opening to an inoperative position spaced from said discharge opening.

9. The comminuting machine as defined in claim 8, wherein:

said displacing means include pressure fluid operated displacing means;

said impact plate having an outer side remote from said rotary impact mechanism;

said pressure fluid operated displacing means including at least one pressure fluid operated piston-cylinder unit linked to said impact plate on said outer side thereof;

said further comminuting means having a front end as viewed in said rotational direction of said rotary impact mechanism; and said at least one pressure fluid operated piston-cylinder unit containing at least one piston rod linked to said front end of said further comminuting means.

10. The comminuting machine as defined in claim 9, further including:

at least one bracket rising from said outer side of said impact plate;

said at least one piston-cylinder unit having a cylinder linked to said at least one bracket;

at least one link member extending upwardly from said front end of said further comminuting means; and said at least one piston-cylinder unit having a piston rod with a free end linked to said at least one link member extending upwardly from said further comminuting means.

11. The comminuting machine as defined in claim 10, wherein:

said plural number of struts of said comb structure formed by said further comminuting means are connected to a common support; and said at least one link member extending upwardly from at least one of said struts.

12. The comminuting machine as defined in claim 8, further including:

at least one threaded bushing having a first end and a second end;

at least one first threaded bolt threaded into said first end of said at least one bushing;

said impact plate having an outer side remote from said rotary impact mechanism;

said at least one first threaded bolt having a free end linked to said outer side of said impact plate;

at least one second threaded bolt threaded into said second threaded end of said at least one bushing;

said further comminuting means having a front end as viewed in said rotational direction of said rotational direction of said rotary impact mechanism; and said second threaded bolt having a free end linked to said front end of said further comminuting means.

13. The comminuting machine as defined in claim 12, further including:

at least one bracket rising from said outer side of said impact plate;

said free end of said at least one first threaded bolt being linked to said at least one bracket;

at least one link member extending upwardly from said front end of said further comminuting means; and said free end of said at least one second threaded bolt being linked to said at least one link member extending upwardly from said further comminuting means.

14. The comminuting machine as defined in claim 13, wherein:

said plural number of said struts of said comb structure formed by said further comminuting means are connected to a common support; and said at least one link member extending upwardly from at least one of said struts.

15. The comminuting machine as defined in claim 12, wherein:

said at least one bushing includes at least two bushings;

said at least one threaded bolt including at least two threaded bolts; and a connecting rod interconnecting said at least two bushings.

16. The comminuting machine as defined in claim 1, wherein:

said impact plate has an inner side facing said rotary impact mechanism;

a plural number of substantially parallel rows of teeth protruding from said inner side of said impact plate in a direction opposing said rotational direction of said rotary impact mechanism;

said plural number of substantially parallel rows of teeth extending substantially transversely with respect to said rotational direction of said rotary impact mechanism;

said substantially transverse, substantially parallel rows of teeth being substantially transversely offset from each other;

said impact plate defining a lengthwise direction extending substantially parallel to said rotational direction of said rotary impact mechanism; and said teeth in said substantially transverse rows of teeth being out of alignment with each other in said lengthwise direction of said impact plate.

17. The comminuting machine as defined in claim 1, further including:

a cover plate having a front end as viewed in said rotational direction of said rotary impact mechanism;

said impact plate having an outer side remote from said rotary impact mechanism;

a plural number of carriers mounted at said outer side of said impact plate and extending to said further comminuting means;

said carriers having free ends to which said front end of said cover plate is pivotably mounted;

said cover plate being pivotable between a first position in which the cover plate essentially covers said predetermined length of said discharge opening of said housing, and a second position in which said cover plate is upwardly pivoted into an open position away from said discharge opening; and said cover plate, in said open position thereof, extending in a downwardly inclined direction.

18. The machine as defined in claim 17, further including:

support members pivotably mounted laterally at said cover plate;

each one of said support members defining a support edge;

said housing defining an outer side adjacent said discharge opening; and said support edge of said support members supporting said cover plate at said outer side of said housing in said upwardly pivoted position of said cover plate.

* * * * *